US006276927B1

(12) United States Patent
Lin

(10) Patent No.: US 6,276,927 B1
(45) Date of Patent: Aug. 21, 2001

(54) NOZZLE ASSEMBLY FOR A GAS BURNER

(76) Inventor: Arlo H. T. Lin, No. 48-15, Sa Tain Road, Sa Lu Chen, Taichung Hsien (TW)

( * ) Notice: Subject to any disclaimer, the term of this patent is extended or adjusted under 35 U.S.C. 154(b) by 0 days.

(21) Appl. No.: 09/566,870

(22) Filed: May 8, 2000

(51) Int. Cl.[7] ..... F23D 14/62

(52) U.S. Cl. ..... 431/354; 239/427; 239/432; 239/500; 239/504; 239/590.3

(58) Field of Search ..... 431/7, 9, 115, 431/329, 346, 354, 355; 126/413, 414; 239/145, 427, 432, 500, 504, 590.3

(56) References Cited

U.S. PATENT DOCUMENTS 881,877 * 3/1908 Von Wouwermans ..... 239/432
2,793,016 * 5/1957 Aghnides ..... 239/391
3,388,868 * 6/1968 Watson et al. ..... 239/427
5,636,981 * 6/1997 Lilly ..... 431/354

FOREIGN PATENT DOCUMENTS

1188444 * 3/1965 (DE) ..... 239/432

* cited by examiner

*Primary Examiner*—Sara Clarke
(74) *Attorney, Agent, or Firm*—Charles E. Baxley

(57) ABSTRACT

A nozzle assembly for a gas burner includes a nozzle body having a tip end and an open end in which three netted members and a stop ring are received. An aperture is defined through a periphery of the nozzle body and the aperture communicates with an interior of the nozzle body and the open end. A space is defined between two adjacent netted members so as to provide a space for mixing gas and air.

1 Claim, 5 Drawing Sheets

NOZZLE ASSEMBLY FOR A GAS BURNER

FIELD OF THE INVENTION

The present invention relates to a nozzle assembly for a gas burner, and more particularly, to a nozzle assembly having three netted members so that gas and air can be mixed therebetween.

A conventional nozzle assembly for a gas burner is shown in FIG. 1 and generally includes a nozzle body 1 with an aperture 11 defined through a periphery thereof. The nozzle body 1 has a tip end and an open end 12 in which a netted member 13 and a stop ring 14 are respectively received. The stop ring 14 prevents the netted members 13 from dropping from the open end 12 of the nozzle body 1. In FIG. 1, the netted member 13 is a wrapped netted member. As shown in FIGS. 2 and 3, the nozzle body 2 has an aperture 21 and an open end 22 for receiving a tubular netted member 23 and a stop ring 24 therein. The stop ring 24 has a protrusion 240 extending inward from an inner periphery of the stop ring 24 to prevent the tubular netted member 23 from passing through the stop ring 24. The nozzle member 2 is connected to a gas burner 4 so that gas enters into the netted member 23 via a passage 41 in the burner 4. There is no extra space for the gas and the air entering from the aperture 21 to be well mixed so that the gas cannot burned completely.

The present invention intends to provide a nozzle assembly for a gas burner that has three netted members in the nozzle body so as to provide enough space to let gas and air well mix.

SUMMARY OF THE INVENTION

In accordance with one aspect of the present invention, there is provided a nozzle assembly for a gas burner and comprising a nozzle body having a tip end and an open end. An aperture is defined through a periphery of the nozzle body and communicates with an interior of the nozzle body and the open end. At least two netted members are received in the nozzle body and a stop ring is engaged with the open end. A space is defined between the at least two netted members.

The object of the present invention is to provide a nozzle assembly having three netted members and a sufficient space is defined between any two adjacent netted members so that gas and air can be well mixed in the nozzle body.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
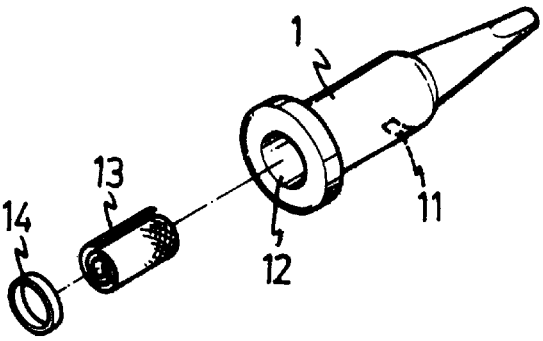
FIG.1 PRIOR ART
FIG. 1 is an exploded view to show a conventional nozzle assembly.
Figure 2:
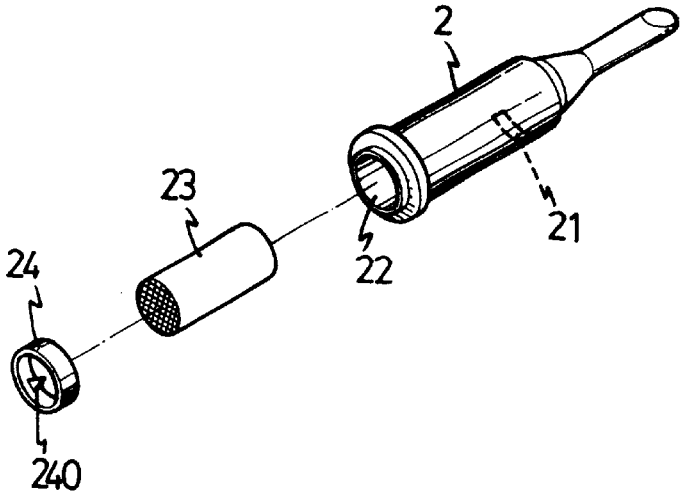
FIG.2 PRIOR ART
FIG. 2 is an exploded view to show another conventional nozzle assembly.
Figure 3:
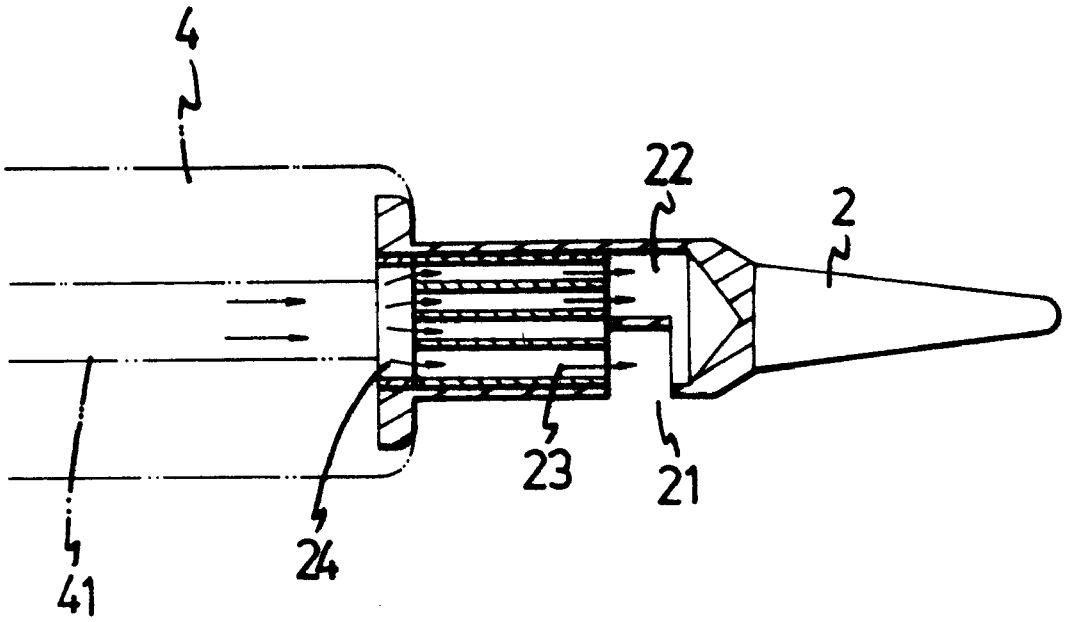
FIG. 3 PRIOR ART
FIG. 3 is a side elevational view, partly in section, of the nozzle assembly as shown in FIG. 2 and which is connected to a barrel of a gas burner.
Figure 4:
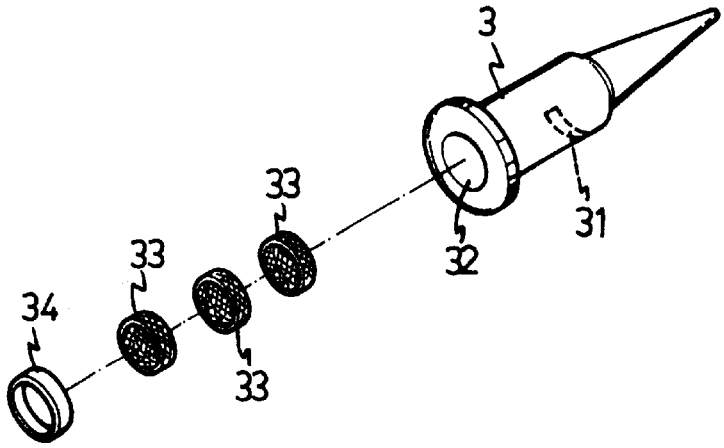
FIG. 4 is an exploded view to show a nozzle assembly of the present invention.
Figure 5:
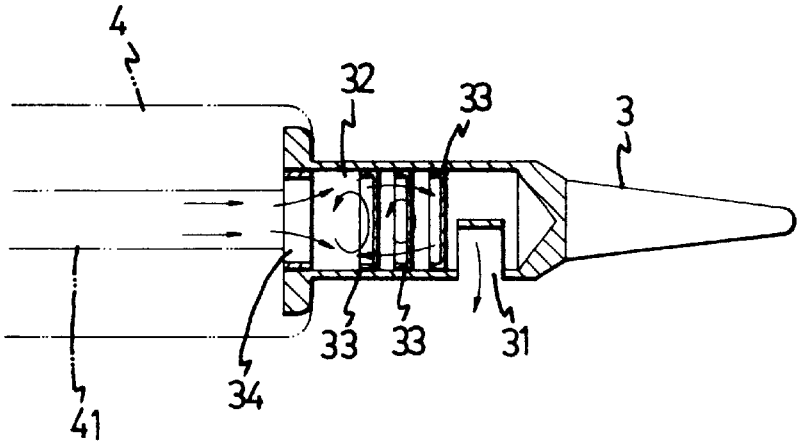
FIG. 5 is a side elevational view, partly in section, of the nozzle assembly of the present invention and which is connected to a barrel of a gas burner.

Referring to FIGS. 4 and 5, the nozzle assembly in accordance with the present invention comprises a nozzle body 3 having a tip end and an open end 32. An aperture 31 is defined through a periphery of the nozzle body 3 and communicates with an interior of the nozzle body 3 and the open end 32. A flange extends radially outward from the open end 32 so as to be engaged with a barrel of a gas burner 4. Three netted members 33 are received in the nozzle body 3 via the open end 32 and a stop ring. 34 is engaged with the open end 32 to prevent the netted members 33 from dropping from the rear end 32. Each of the three netted members 33 is a round member and an annular flange extending from a side of each of the at least two netted members 33. A space is defined between any two adjacent netted members 33.

Figure 7:
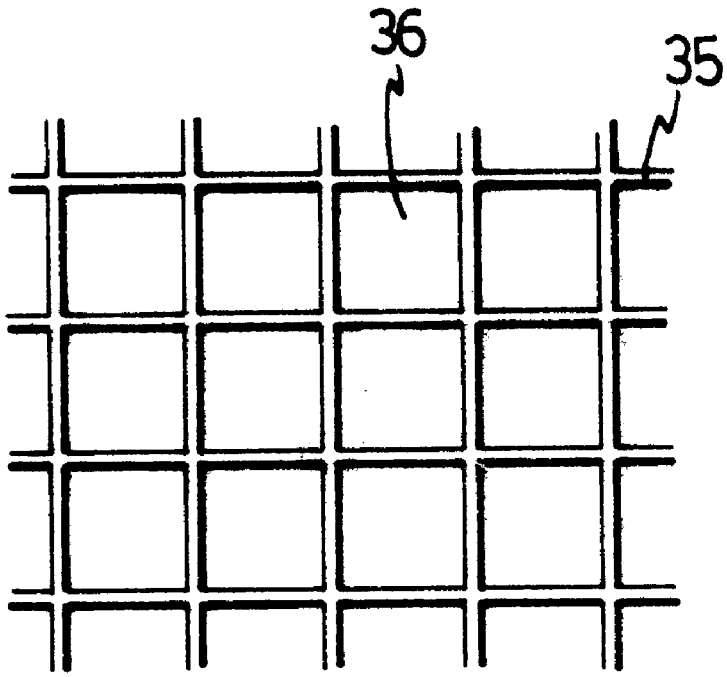
FIG. 7 is an illustrative view to show the netted members of the present invention having larger holes.

As shown in FIG. 7, the netted member 33 has thicker metal wires 35 and larger holes 36 so that the gas enters in the nozzle body 3 from a passage 41 of the gas burner can be completely mixed with air entering the nozzle member 3 via the larger holes 36. The space provides a sufficient space to let the gas mix with the air so that the combustion is improved.

Figure 6:
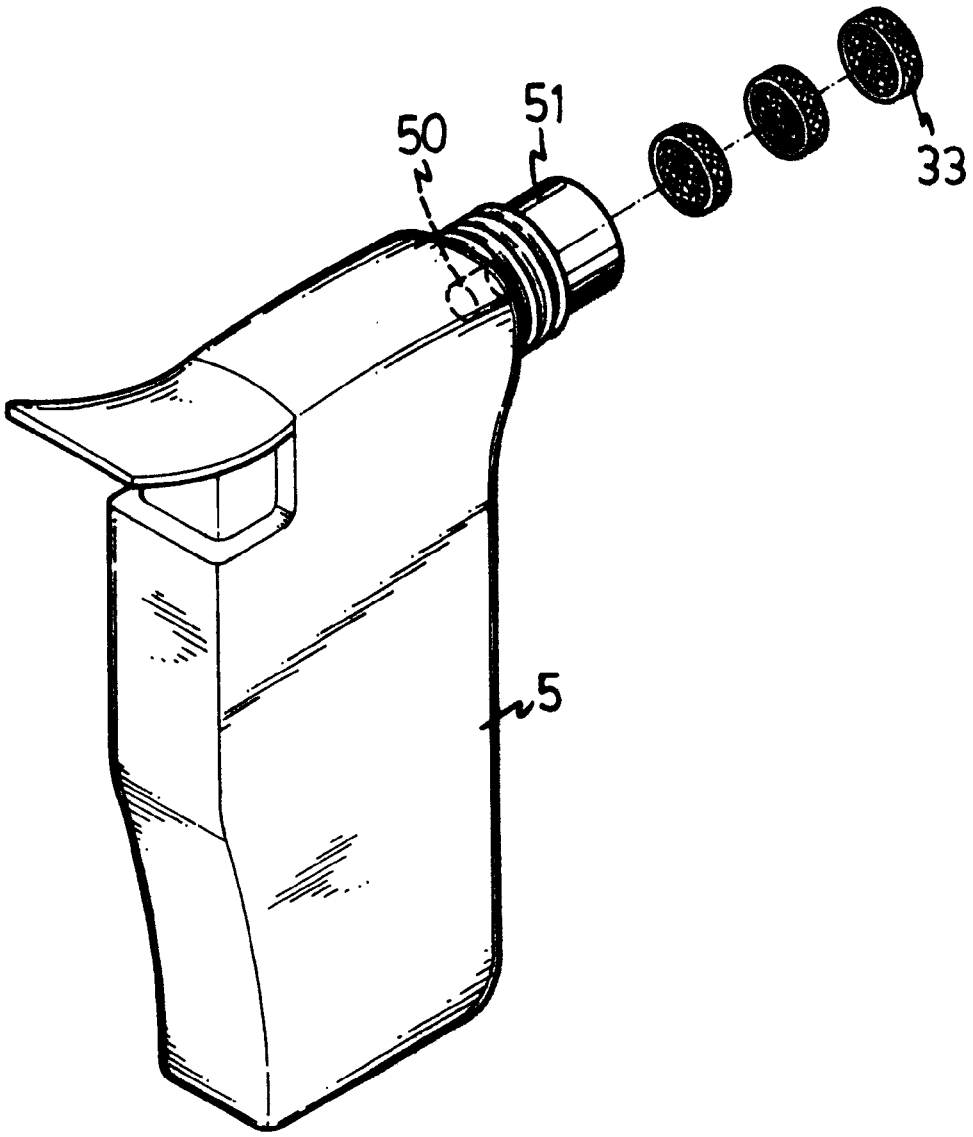
FIG. 6 is a perspective view to show the netted members can be cooperated with a heat blower.

FIG. 6 shows that the netted members 33 of the present invention can also be engaged with an outlet 51 of a heat blower 5. A gas dispenser 50 in the blower 5 ejects gas stream to the heated netted members 33 to form a burning gas stream.

While we have shown and described various embodiments in accordance with the present invention, it should be clear to those skilled in the art that further embodiments may be made without departing from the scope and spirit of the present invention.

What is claimed is:

1. A nozzle assembly for a gas burner, comprising:

a nozzle body having a tip end and an open end, an aperture defined through a periphery of said nozzle body, said aperture communicating with an interior of said nozzle body and said open end, and at least two netted members received in said nozzle body via said open end and a stop ring engaged with said open end, a space defined between said at least two netted members, each of said at least two netted members being a round member and an annular flange extending from a side of each of said at least two netted members.

* * * * *